United States Patent [19]

Akeno

[11] Patent Number: 4,825,514

[45] Date of Patent: May 2, 1989

[54] TOP STOP FOR WATER-TIGHT SLIDE FASTENER

[75] Inventor: Mitsuru Akeno, Toyama, Japan

[73] Assignee: Yoshida Kogyo K. K., Tokyo, Japan

[21] Appl. No.: 127,762

[22] Filed: Dec. 24, 1987

[30] Foreign Application Priority Data

Dec. 26, 1986 [JP] Japan ..... 61-199325

[51] Int. Cl.[4] ..... A44B 19/32

[52] U.S. Cl. ..... 24/389; 24/387

[58] Field of Search ..... 24/389, 384, 401, 387

[56] References Cited

U.S. PATENT DOCUMENTS

| | | | |
|---|---|---|---|
| 2,496,878 | 2/1950 | Krupp | 24/389 |
| 2,535,391 | 12/1950 | Clarke . | |
| 2,800,699 | 7/1957 | Armstrong . | |
| 3,409,953 | 11/1968 | Briscoe | 24/389 |
| 3,668,745 | 6/1972 | Krupp | 24/389 |
| 4,524,493 | 6/1985 | Inamura | 24/389 |
| 4,604,775 | 8/1986 | Kusayama | 24/389 |

FOREIGN PATENT DOCUMENTS 1478100 6/1977 United Kingdom .

*Primary Examiner*—Kenneth J. Dorner
*Assistant Examiner*—Laurie K. Cranmer
*Attorney, Agent, or Firm*—Hill, Van Santen, Steadman & Simpson

[57] ABSTRACT

A top stop for a water-tight slide fastener includes a generally C-shaped inner sealing body for water-tightly surrounding a diamond of a slider when the slide fastener is fully closed, and a generally C-shaped outer sealing body integral with the inner sealing body and extending around the outer periphery of the inner sealing body for water-tightly covering the flared mouth of a Y-shaped guide channel of the slider when the slide fastener is fully closed.

11 Claims, 3 Drawing Sheets

TOP STOP FOR WATER-TIGHT SLIDE FASTENER

BACKGROUND OF THE INVENTION

1. Field of the Invention

The present invention relates to a top stop for a water-tight slide fastener suitable for working clothes for construction workers in rivers, fishermen and farmers.

2. Description of the Prior Art

As shown in FIGS. 5 and 6 of the accompanying drawings, a conventional top stop for a water-tight slide fastener includes a generally C-shaped sealing body C disposed at a top end of the slide fastener and defining a central opening A for receiving a diamond F of a slider D as the slide fastener is fully closed and also defining a passageway B communicating with the central opening A for the passage of the diamond F of the slider D. When the slider D is pulled all the way to fully close the slide fastener, opposite end portions of the sealing body C are inserted into a Y-shaped guide channel of the slider D and are then forced against each other and the diamond F of the slider D under the pressure of opposite side flanges E of the slider D, thus providing a water-tight sealing around the diamond F. With this conventional top stop, as stress or additional pressure of water was exerted on the slide fastener to deform the stringer tapes when the workman moved in water, penetration of water through the central opening occasionally occurred, thus causing an inadequate degree of water-tightness.

SUMMARY OF THE INVENTION

It is therefore an object of the present invention to provide a top stop for a water-tight slide fastener which preserves adequate water-tightness even when the slide fastener is deformed by due stress or pressure of water.

According to the present invention, a top stop for a water-tight slide fastener includes a generally C-shaped inner sealing body defining a central opening for receiving a diamond of a slider and also defining a passageway for passage of the diamond, and a generally C-shaped outer sealing body extending on and around an outer periphery of the inner sealing body for water-tightly closing a flared mouth of a Y-shaped guide channel of the slider as the slide fastener is fully closed.

Many other advantages, features and additional objects of the present invention will become manifest to those versed in the art upon making reference to the detailed description of the accompanying drawings in which a preferred structural embodiment incorporating the principle of the present invention is shown by way of illustrative example.

DETAILED DESCRIPTION

Figure 4:
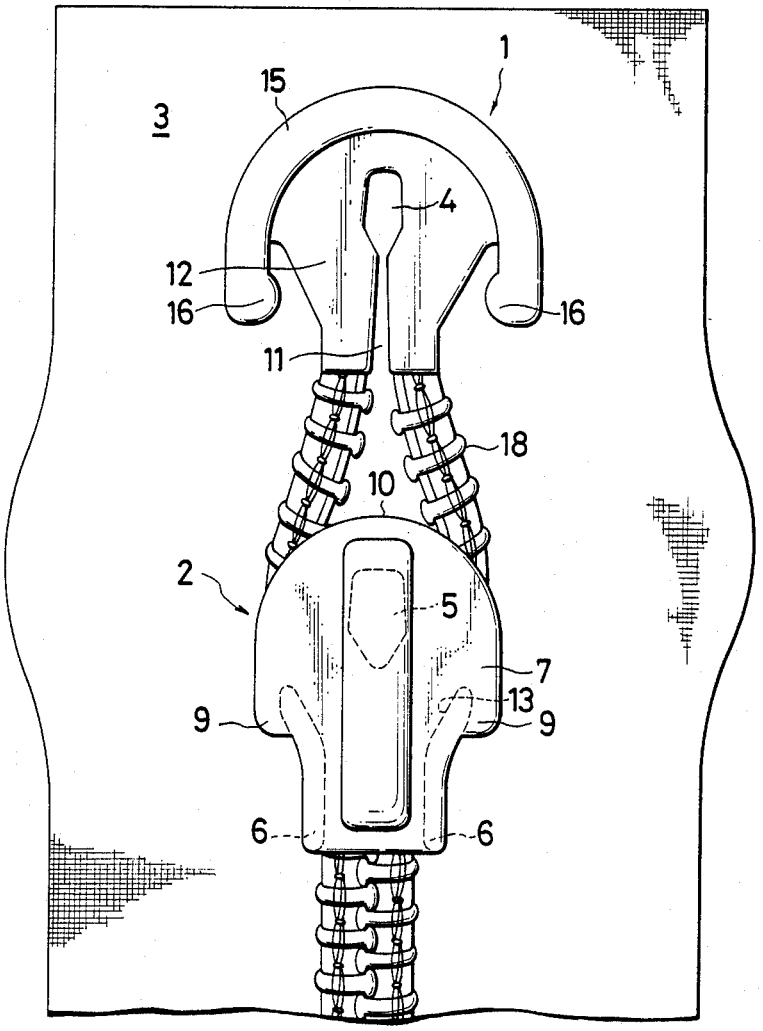
FIG. 4 is a fragmentary plan view of a water-tight slide fastener to which the top stop is attached.
Figure 5:
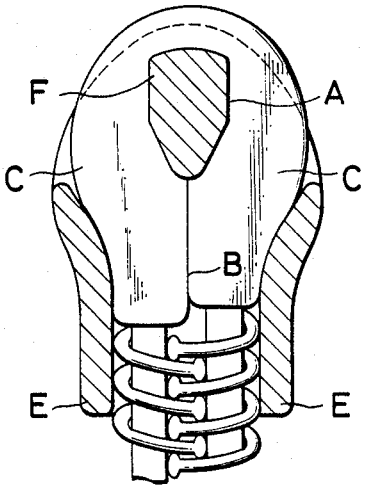
FIG. 5 PRIOR ART
FIG. 5 is a cross-sectional view taken along line V—V of FIG. 6, showing a prior art top stop.
Figure 6:
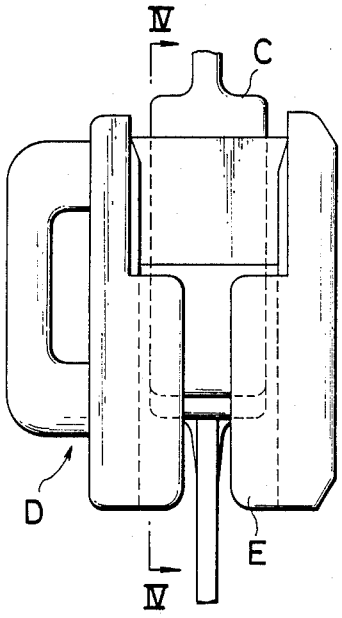
FIG. 6 PRIOR ART

FIG. 4 shows a water-tight slide fastener having a top stop 1 embodying the present invention. The slide fastener includes a stringer tape 3, a pair of rows of fastener elements 18, 18 mounted on the stringer tape 3 along opposed inner longitudinal edges thereof, and a slider 2 threaded on the pair of rows of fastener elements 18, 18. The top stop 1 is disposed at the top end of the pair of rows of fastener elements 18, 18 for restricting the upward movement of the slider 2.

The slider 2 includes upper and lower wings 7, 8 joined at one end by a diamond 5 so as to define a generally Y-shaped guide channel 13 for the passage of the pair of fastener element rows 18, 18. Each of the upper and lower wings 7, 8 has opposite side flanges 6 and lateral projections 17 and is thick at the area 14 (FIG. 2) between the diamond 5 and the slide flanges 6.

As shown in FIGS. 1 through 4, the top stop 1 includes a generally C-shaped inner sealing body 12 defining a central opening 4 for receiving the diamond 5 of the slider 2 when the slider 2 is moved upwardly all the way of fully close the slide fastener and also defining a passageway 11 (best shown in FIG. 4) communicating with the central opening 4 for the passage of the diamond 5. When the slider 2 is pulled upwardly all the way to fully close the slide fastener, opposite end portions of the inner sealing body 12 are inserted into the Y-shaped guide channel 13 of the slider 2 and are then forced against each other and the diamond 5 of the slider 2 under the pressure of the opposite side flanges 6, 6 of the slider 2, thus providing a water-tight sealing around the diamond 5.

Most important, the top stop 1 also includes a generally C-shaped outer sealing body 15 integral with the inner sealing body 12 and extending on and around the outer periphery of the inner sealing body 12 for water-tightly covering or closing a flared mouth 10 of the Y-shaped guide channel 13.

Figure 2:
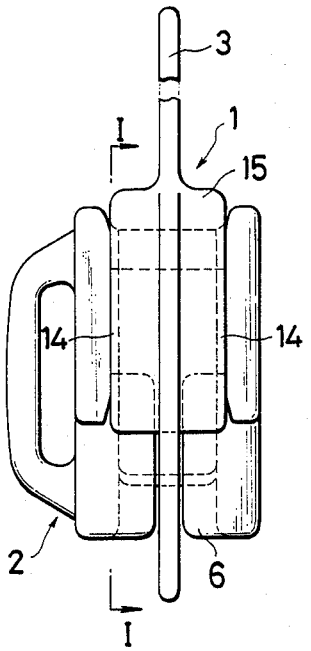
FIG. 2 is a side elevational view of the top stop.
Figure 3:
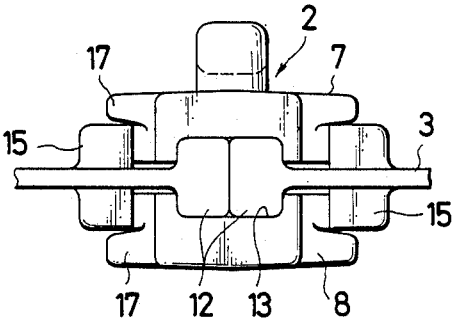
FIG. 3 is a bottom view of the top stop.

The tape 3 is made of a water-tight and elastic material, such as soft synthetic resin (e.g. polyvinyl chloride) and synthetic rubber. The top stop 1 is also made of a water-tight and elastic material, such as soft synthetic resin (e.g. polyvinyl chloride) and synthetic rubber, and is formed on front and rear surfaces of the tape 3 integrally therewith. As shown in FIGS. 2 and 3, the inner sealing body 12 has a thickness larger than the thickness of the tape 3, and the outer sealing body 15 has a thickness larger than the thickness of the inner sealing body 12.

As the slide fastener is fully closed, the inner sealing body 12 is snugly fitted in the guide channel 13 and completely surrounds the diamond 5, and at the same time, the outer sealing body 15 completely covers the flared mouth 10 of the guide channel 13. With this double-sealed construction, adequate water-tightness can be preserved even when the slide fastener is deformed by due stresses or due pressure of water.

Figure 1:
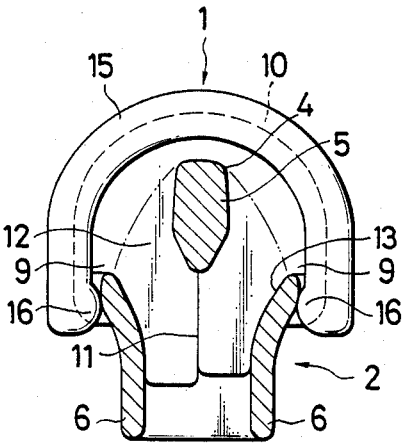
FIG. 1 is a cross-sectional view take along line I—I of FIG. 2, showing a top stop of the present invention.

As shown in FIGS. 1 and 4, the outer sealing body 15 has at its opposite ends a pair of inwardly directed projections 16 which are engageable with the outer surfaces of the opposed flanges 6 of the slider 2 and also with shoulders 9 (FIGS. 1 and 4) of the slider 2 as the slide fastener is fully closed (FIG. 1). These projections 16 serve to assist in sealing the slider 2.

Although in the illustrated embodiment the top stop 1 projects from opposite surfaces of the tape 3, it may project from only one surface of the tape 3. Further, the top stop 1 may be formed independently of the tape 3.

Although various minor modifications may be suggested by those versed in the art, it should be understood that we wish to embody within the scope of the patent warranted hereon, all such embodiments as reasonably and properly come within the scope of my contribution to the art.

What is claimed is:

1. A water-tight slide fastener comprising:

(a) a stringer tape of a water-tight material having a pair of opposed inner longitudinal edges;

(b) a pair of rows of fastener elements mounted on said stringer tapes along said opposed inner longitudinal edges, respectively, (c) a slider slidably mounted on said rows of coupling elements for taking them into and out of meshing engagement with each other to close and open the slide fastener, said slider including upper and lower wings joined at one end by a diamond so as to define therebetween a Y-shaped guide channel for the passage of said rows of fastener elements, at least one of said wings having a pair of opposite side flanges defining a part of said Y-shaped guide channel, said Y-shaped guide channel having a flared mouth; and (d) a top stop disposed at a top end of said pair of rows of fastener elements for restricting the movement of said slider in a direction to close the slide fastener, said top stop including (i) first seal elastic means snugly receivable in said Y-shaped guide channel for sealingly surrounding said diamond of said slider when said slider is moved toward said top stop to fully close the slide, fastener, and (ii) second elastic seal means integral with said first elastic seal means and snugly receivable in said flared mouth of said Y-shaped guide channel for sealingly closing said flared mouth when the slide fastener is fully closed said second elastic seal means having opposite end portions spaced from and extending along opposite end portions of said first elastic seal means, said opposite end portions of said second elastic seal means having a pair of inwardly directed projections, respectively, engageable with outer surfaces of said side flanges of said slider when the slide fastener is fully closed.

2. A water-tight slide fastener according to claim 1, said first elastic seal means including a generally C-shaped inner seal body of an elastic material, said inner seal body defining a central opening for receiving said diamond when the slide fastener is fully closed and also defining a passageway communicating with said central opening for the passage of said diamond such that said passageway is fully closed along its length when said slider is moved to its fully closed position, said C-shaped inner seal body having said opposite end portions sealingly engageable with each other and also with inner surfaces of said side flanges of said at least one wing, and second elastic seal means including a generally C-shaped outer seal body of an elastic material extending on and around an outer periphery of said inner seal body and having an inner peripheral portion sealingly receivable in said flared mouth of said Y-shaped guide channel.

3. A water-tight slide fastener according to claim 2, said slider having lateral shoulders and said inner peripheral portion of said outer seal body being sealingly engageable with said lateral shoulders.

4. A top stop according to claim 1, wherein said first and second seam means are mounted on said stringer tape and structurally independent of said stringer tape.

5. A slide fastener according to claim 1, wherein said first and second seal means are formed of a soft synthetic resin.

6. A slide fastener according to claim 3, wherein said soft synthetic resin is polyvinyl chloride.

7. A slide fastener according to claim 1, wherein said first and second seal means are formed of rubber.

8. A slide fastener according to claim 1, wherein said first and second seal means are formed on said stringer tape integrally therewith.

9. A slide fastener according to claim 1, wherein said first and second seal means project from only one surface of said stringer tape.

10. A slide fastener according to claim 1, wherein said first and second seal means project from both surfaces of said stringer tape.

11. A slide fastener according to claim 1, wherein said first seal means has a thickness larger than the thickness of said stringer tape, and said second seal means has a thickness larger than the thickness of said first seal means.

* * * * *

UNITED STATES PATENT AND TRADEMARK OFFICE

CERTIFICATE OF CORRECTION

PATENT NO. : 4,825,514

DATED : May 2, 1989

INVENTOR(S) : Mitsuru Akeno

It is certified that error appears in the above—identified patent and that said Letters Patent is hereby corrected as shown below: On the title page:

--Please correct the serial number on the specification to read:

--137,762--.

Signed and Sealed this

Twenty-third Day of April, 1991

*Attest:*

*Attesting Officer*

HARRY F. MANBECK, JR.

*Commissioner of Patents and Trademarks*